US008701976B2

(12) United States Patent
Earnshaw

(10) Patent No.: US 8,701,976 B2
(45) Date of Patent: Apr. 22, 2014

(54) SHIPPING CONTAINER

(75) Inventor: Gerald Christopher Earnshaw, Naugatuck, CT (US)

(73) Assignee: Connecticut Container Corp., North Haven, CT (US)

( * ) Notice: Subject to any disclaimer, the term of this patent is extended or adjusted under 35 U.S.C. 154(b) by 364 days.

(21) Appl. No.: 13/195,997

(22) Filed: Aug. 2, 2011

(65) Prior Publication Data

US 2013/0032632 A1 Feb. 7, 2013

(51) Int. Cl.
*B65D 5/10* (2006.01)

(52) U.S. Cl.
USPC ..... 229/150

(58) Field of Classification Search
USPC ..... 229/150, 155, 149, 151, 154, 121, 131, 229/117.01, 102; 224/607; 206/807
See application file for complete search history.

(56) References Cited

U.S. PATENT DOCUMENTS 2,465,324 A * 3/1949 De Mian ..... 229/125.08
3,064,877 A * 11/1962 Forrer et al. ..... 229/150
4,131,229 A * 12/1978 Nastasi ..... 229/153
4,291,826 A 9/1981 Swanson
4,337,888 A * 7/1982 Kudalkar ..... 229/198.2
4,339,069 A * 7/1982 Poteet ..... 229/117.17
4,583,678 A 4/1986 Weimer, Jr.
4,717,023 A 1/1988 Oprean
4,830,270 A * 5/1989 Holmes ..... 229/102
4,946,093 A 8/1990 Moorman
4,971,242 A 11/1990 LaNicca
5,154,392 A 10/1992 Voight
5,305,950 A 4/1994 Oppenheim
6,364,200 B1 4/2002 Moss
6,688,514 B2 2/2004 Evans
6,915,947 B2 7/2005 Siurek
7,007,613 B2 3/2006 Sketo
7,131,570 B2 11/2006 Quaintance
7,469,815 B2 12/2008 Quaintance
7,823,725 B1 11/2010 Shupe

* cited by examiner

*Primary Examiner* — Justin Larson
*Assistant Examiner* — Phillip Schmidt
(74) *Attorney, Agent, or Firm* — Wiggin and Dana LLP; Gregory S. Rosenblatt

(57) ABSTRACT

A shipping container has a lid locked using pressure, rather than friction. The container includes front and rear side panels and a lid. The lid has a positive locking tab for engaging with a slot in the front side panel. The tab has a greater length than the slot. An end of the tab and an edge of the lid form a notch therebetween. In an embodiment, a corrugated paperboard blank is folded to approximate the lid to the front side panel. The lid is folded along an angled score line, rotating the tab with respect to the slot so that an end of the tab engages the slot and the front panel at an end of the slot engages the notch. The lid is folded to rotate the tab in the opposite direction; the tab then engages with the slot, the end of the tab extending beyond the slot.

14 Claims, 3 Drawing Sheets

SHIPPING CONTAINER

FIELD OF THE DISCLOSURE

This disclosure relates to shipping containers, and more particularly to a container formed by folding a flat piece of corrugated material, where the container is also tamper-evident and tamper-resistant.

BACKGROUND OF THE DISCLOSURE

Shipping containers made from corrugated paperboard are well known. It is convenient to shape a flat blank of corrugated paperboard and provide the blank with score lines, and then construct the container by folding the blank when the container is needed. Such containers typically depend on friction to hold their shape (particularly friction between slots and tabs inserted in those slots) or on fasteners (adhesive tape, glue, staples, or the like) connecting parts of the container. It is often seen as desirable to assemble a container without the need for fasteners. However, when a container is formed only by folding tabs to insert in slots, it may easily be tampered with; one may remove several tabs from their slots, gain access to the interior of the container, and re-insert the tabs so that the outward appearance of the container is unchanged. A container constructed by relying on slot/tab friction is therefore neither tamper-resistant nor tamper-evident.

It is desirable to construct a shipping container by folding a flat blank, where the finished container holds its shape without fasteners and also is tamper-evident and tamper-resistant.

SUMMARY OF THE DISCLOSURE

In accordance with an aspect of the disclosure, a shipping container includes a bottom panel; a rear side panel and a front side panel each connected to the bottom panel; and a lid connected to the rear side panel along an upper edge thereof. The lid has a positive locking tab for engaging with a slot disposed in the front side panel. The positive locking tab has a length greater than the length of the slot. The positive locking tab may be viewed as including a main portion and an end portion, with the main portion and end portion having a combined first length greater than the length of the slot; the main portion is connected to the lid along a second length, the second length being approximately equal to the length of the slot. The end portion of the positive locking tab and an edge of the lid form a notch therebetween for engaging with the front side panel at an end of the slot. In an embodiment, the container also includes a front edge panel connected to the front side panel along the upper edge of the front side panel. The container has a fold along the upper edge of the front side panel; the slot is formed along the fold, so that engaging the notch causes the end portion of the locking tab to be captured beneath the fold and between the front side panel and the front edge panel.

In accordance with another aspect of the disclosure, a blank foldable into a container includes a bottom panel; a rear panel connected to the bottom panel along a lower rear score line; a front panel connected to the bottom panel along a lower front score line, the front panel having a slot formed therein; and a lid connected to the rear side panel along an upper rear score line. The lid has a positive locking tab connected thereto; the positive locking tab has a length greater than the length of the slot. The end portion of the positive locking tab and an edge of the lid form a notch therebetween. The lid includes a central portion and an adjacent corner portion connected to the central portion along a score line angled with respect to the edge of the lid and intersecting the edge of the lid at a closed end of the notch. In an embodiment, the blank is formed of corrugated paperboard.

In accordance with another aspect of the disclosure, a method for forming a container includes providing a foldable blank as described just above. The blank is folded along the lower rear score line, the lower front score line, and the upper rear score line to approximate the edge of the lid to the front panel. The blank is then folded along the angled score line, thereby rotating the positive locking tab with respect to the slot in a first rotation direction. The end portion of the positive locking tab engages with the slot; the front panel (at an end of the slot) engages with the notch. The blank is folded again along the angled score line, thereby rotating the positive locking tab in a second rotation direction opposite the first rotation direction so that the main portion of the positive locking tab engages with the slot and the end portion of the positive locking tab extends beyond the slot.

It is noteworthy that in embodiments of the disclosure, the lid of the container is locked using pressure, as opposed to friction. Unlike a positive locking tab as in the present disclosure, an arrangement using friction between a tab and a slot is not made stronger by pressure.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

According to an embodiment of the disclosure, a shipping container is constructed by folding a flat blank 100 along score lines provided therein (see FIG. 1), with tabs inserted into slots to hold the sides of the container in place. The term "score line," as used herein, refers to any linear formation in the blank (a groove, perforations, or the like) facilitating folding along that line. The lid of the container is secured by pressure on a locking tab, as opposed to friction between a tab and a slot, as described in more detail below.

Figure 1:
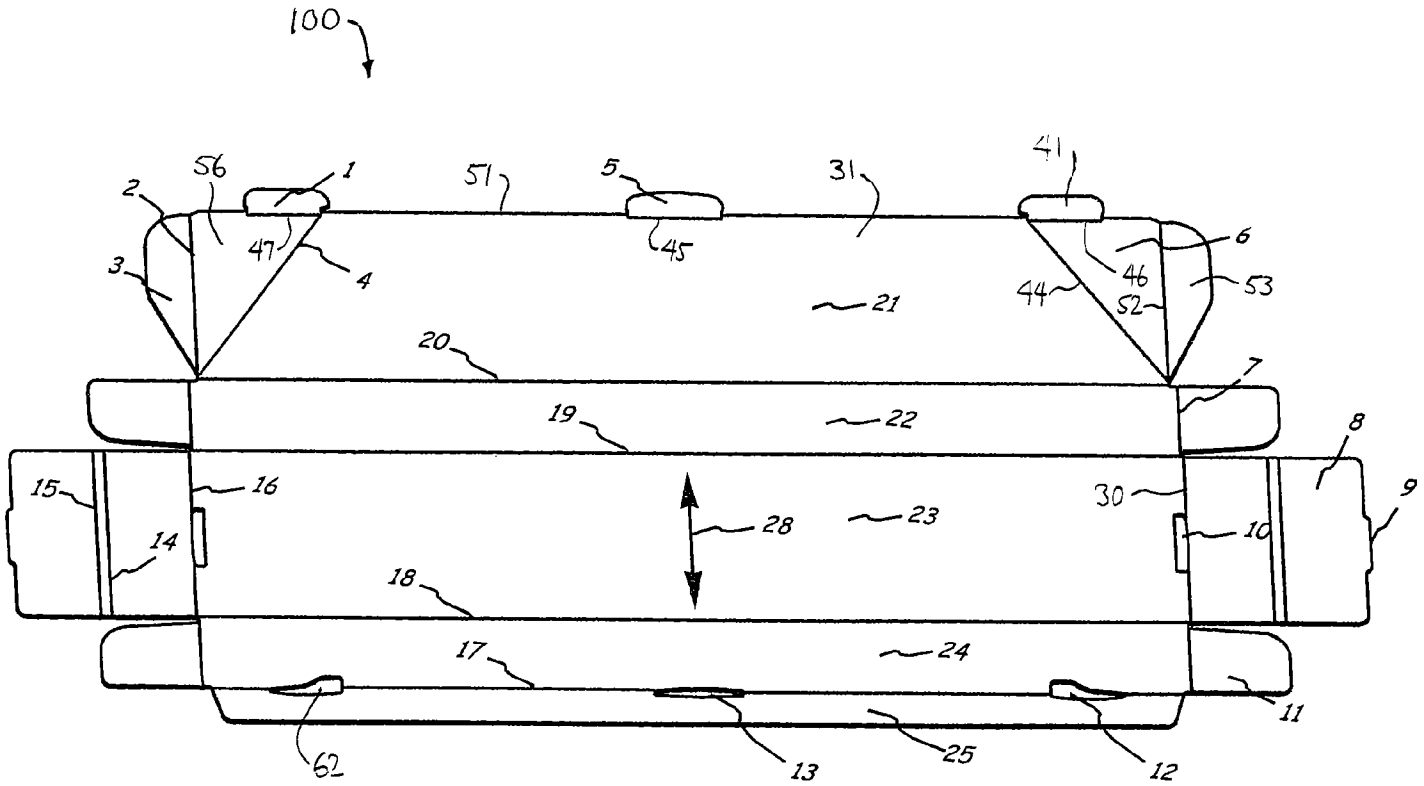
FIG. 1 is a plan view of a blank for forming a shipping container in accordance with the disclosure.

Referring to FIG. 1, blank 100 is shaped and scored so that the resulting shipping container has an elongated rectangular oblong shape. In an embodiment, blank 100 is corrugated paperboard, with the preferred corrugation direction shown by arrow 28. It will be appreciated that a variety of materials may be used, and that containers of a variety of shapes may be provided.

The bottom panel 23 of the container is bounded by score lines 16, 18, 19, 30. The blank is folded along score line 19 so that elongated rear side panel 22 makes approximately a right angle with bottom panel 23. The blank is folded along score line 18 so that an elongated front side faces opposite rear side panel 22, both front and rear sides making approximately a right angle with bottom panel 23. In this embodiment, the front side includes front side panel 24 and front edge panel 25; front edge panel 25 is adjacent to front side panel 24 along score line 17. Front edge panel 25 is folded along score line 17, so that front edge panel 25 extends into the interior of the container toward rear side panel 22, and the top edge of front side panel 24 is defined by score line 17.

A central elongated slot 13 and two asymmetric slots 12, 62, one near each end of the container, are disposed along score line 17. Accordingly, these slots open upwards at the top edge of front side panel 24. Slots 62, 13, 12 are sized and located so as to engage with tabs 1, 5, 41 respectively at the edge 51 of lid 31 when the lid is closed, as explained in detail below.

In this embodiment, the opposite ends of the container are both formed in the same manner. End panels 8, located adjacent to the short ends of bottom 23 along score lines 16, 30 respectively, each have two parallel score lines 14, 15 and a tab 9 for engaging with slot 10 at opposite ends of bottom 23. Front side panel 24 and rear side panel 22 are bounded at their respective ends by score lines 7, with flaps 11 adjacent thereto and extending from the ends of the respective front and rear side panels. Each end of the container is formed by folding flaps 11 inward so that they point toward each other and parallel to score lines 16, 30; folding end panel 8 upwards along score lines 16, 30; folding end panel 8 along score lines 14, 15 inwards and down over flaps 11; and inserting tab 9 into slot 10, thereby capturing flaps 11.

The lid 31 of the container, according to this embodiment, is adjacent to rear side panel 22 along score line 20. Score line 20 defines the upper edge of rear side panel 22. With the rear side panel 24 and front side panel 22 folded upward with respect to bottom panel 23, it may be seen that FIG. 1 shows the underside of lid 31. Closing and locking the container begins with folding lid 31 in a forward direction (that is, moving lid 31 in the general direction of front side panel 24) along score line 20.

Lid 31 includes a central lid portion 21 with tab 5 centrally located along the edge 51. At one end of lid 31, an angled score line 4 divides central portion 21 from lid corner portion 56. A tuck flap 3 is adjacent to lid corner portion 56 along score line 2. Locking tab 1 extends from edge 51. At the opposite end of lid 31, an angled score line 44 divides central portion 21 from lid corner portion 6. A tuck flap 53 is adjacent to lid corner portion 6 along score line 52. Locking tab 41 extends from edge 51. In this embodiment, angled score lines 4, 44 intersect score line 20 at opposite ends of the lid (that is, at respective rear corners of the lid). When the lid is folded forward, edge 51 moves downward to approximate the top edge of front side panel 24.

Figure 2A:
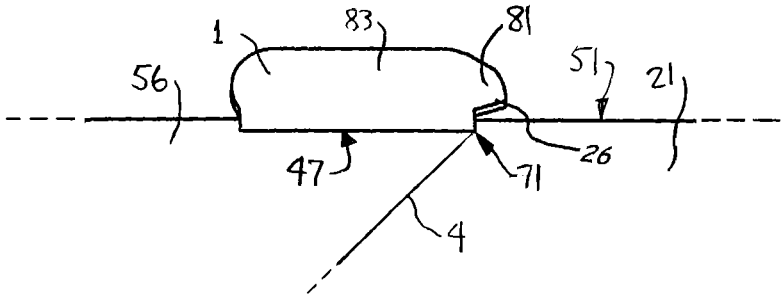
FIG. 2A is a detail view of FIG. 1, showing a self-locking tab in an embodiment of the disclosure.

FIG. 2A is a detail view of FIG. 1, showing locking tab 1. Tab 1 is adjacent to angled lid end portion 56 along line 47 (which may be a score line). Tab 1 may be viewed as having a main portion 83 with line 47 forming an edge thereof, and an end portion 81 extending from the main portion. The inner end of tab 1 (that is, the end closest to central tab 5) is formed so that a notch 26 is between the end portion 81 of tab 1 and edge 51. As shown in FIG. 2A, notch 26 has an open end oriented inward (that is, toward central tab 5) and a closed end where angled score line 4 meets tab 1 at the inward extremity 71 of line 47.

Figure 2B:
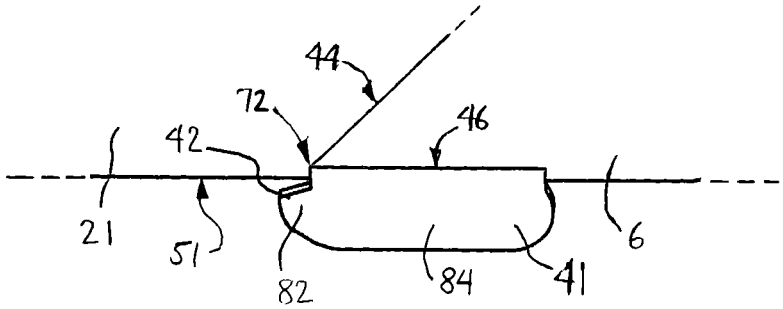
FIGS. 2B and 2C respectively show a self-locking tab and a slot oriented to engage with each other to close and lock the lid of a shipping container embodying the disclosure.

FIG. 2B shows locking tab 41 as viewed from above as lid 31 is closed (that is, with the top side of the lid visible). Tab 41 is disposed in a position corresponding to that of tab 1, near the opposite end of the lid, and is adjacent to the other angled lid end portion 6 along line 46 (which may be a score line). Tab 41 may be viewed as having a main portion 84 with line 46 forming an edge thereof, and an end portion 82 extending from the main portion. The inner end of tab 41 is formed so that a notch 42 is between the end portion 82 of tab 41 and edge 51. Notch 42 has an open end oriented inward and a closed end where angled score line 44 meets tab 41 at the inward extremity 72 of line 46.

Figure 2C:
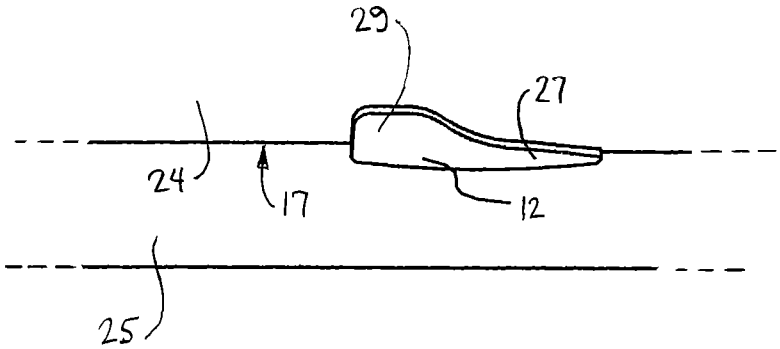

FIG. 2C is an additional detail view showing slot 12. As shown in FIG. 2C, slot 12 has a tapered shape with a wide inner end 29 and a narrow outer end 27. Slot 62 is similarly shaped, also having a wide inner end and a narrow outer end (see FIG. 1). In this embodiment, two sets of corresponding locking tabs and slots are arranged symmetrically with respect to the lateral midline of the container (running through central tab 5 and slot 13, and aligned with arrow 28 in FIG. 1).

In this embodiment, the overall length of each of the locking tabs 1 and 41 (the main portion with the end portion of the locking tab), in a direction parallel to edge 51, is greater than the length of slots 62 and 12 respectively in a direction along score line 17, while the length of the main portions 83 and 84 of locking tabs 1 and 41 is approximately equal to the respective lengths of slots 62 and 12.

Figure 3:
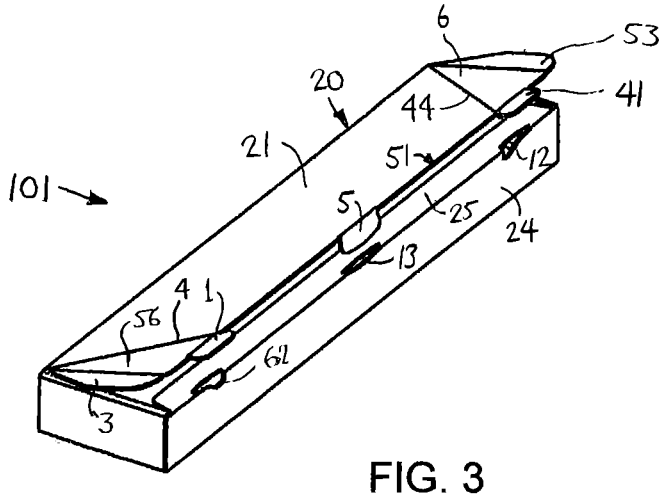
FIG. 3 is a perspective view of a container formed by folding the blank of FIG. 1, showing the top of the container ready to be closed and locked.
Figure 4:
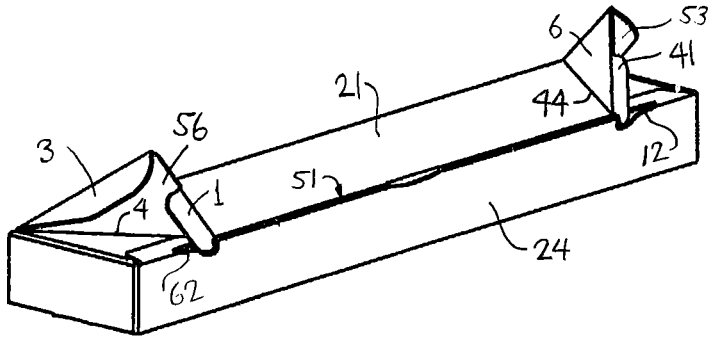
FIG. 4 shows the container of FIG. 3 with the top closed except for corner portions thereof, with locking tabs engaging their corresponding slots.
Figure 5:
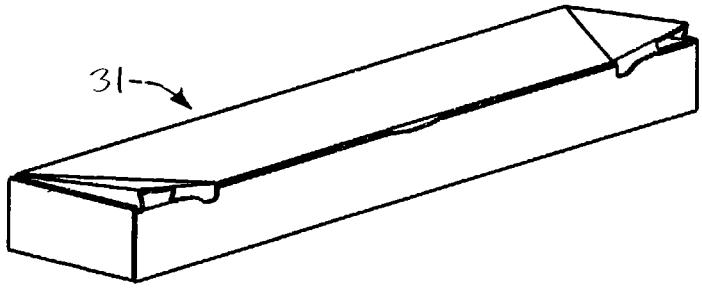
FIG. 5 shows the container of FIG. 4 with the locking tabs engaged with their corresponding slots, thereby closing and locking the container.

Steps in closing and locking the lid of the container 101 are illustrated in FIGS. 3-5. As shown in FIG. 3, lid 31 (including central portion 21, angled corner portions 6, 56 and flaps 53, 3) is folded forward and downward along score line 20. Tab 5 is folded downward with respect to central lid portion 21 along line 45, so that it points downward toward slot 13.

Referring to FIG. 4, locking tabs 1, 41 are folded downwards with respect to the angled corner portions 56, 6, making approximately a right angle therewith. The angled corner portions 6, 56 are folded upward (that is, away from the interior of the container) along angled score lines 44, 4 respectively. This causes locking tabs 1, 41 to rotate upwards and inwards with respect to central portion 21, the score lines 4, 44 being the axes of rotation. In particular, the rotation of locking tabs 1 and 41 causes notches 26, 42 to have their open ends rotated downward. Tuck flaps 53, 3 are folded downwards with respect to the angled corner portions 6, 56, making approximately right angles therewith.

Lid 31 is then brought downward so that, in the central portion 21 of the lid, edge 51 approximates the top edge of the front side panel 24. Locking tab 5 engages with slot 13, making a friction fit. The rotation of locking tabs 1, 41 permits the end portions 81, 82 thereof to engage slots 62 and 12 respectively, and furthermore permits notches 26, 42 engage the inner ends of slots 62, 12.

Locking the lid 31 is performed by rotating angled corner portions 6, 56 and pressing them downwards, so that angled corner portions 6, 56 again are substantially coplanar with central lid portion 21 (see FIG. 5). Locking tabs 1, 41 accordingly rotate so that notches 26, 42 continue to engage the inward ends of slots 62, 12 while the end portions 81, 82 of the locking tabs extend inwards therefrom. The end portions 81, 82 are thus captured beneath the fold along score line 17, between the front side panel 24 and front edge panel 25. The respective opposite ends of locking tabs 1, 41 also engage slots 62, 12 and make a friction fit with the narrow ends 27 of the slots. Tuck flaps 3, 53 tuck into the container by sliding adjacent and parallel to the respective inner faces of folded end panels 8.

It will be appreciated that, due to the rotation of locking tabs 1 and 41 and the resulting capture of their respective inner portions 81 and 82, container 101 is self-locking. Proper insertion of tabs 1 and 41 into slots 62 and 12 causes lid 31 to be locked, so that it cannot be opened as a conventional box lid without damage to the locking tabs and/or the slots. Accordingly, container 101 is both tamper-resistant and tamper-evident. Container 101 may also be closed and locked more quickly and easily than a conventional container having tabs friction-fit into slots. Furthermore, container 101 may be constructed from blank 100 without fasteners, tape or glue. The container may also be re-used after being locked and subsequently opened (even though it is then no longer tamper-resistant or tamper-evident).

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

What is claimed is:

1. A container comprising:

a bottom panel;

a rear side panel and a front side panel each connected to the bottom panel; and a lid connected to the rear side panel along an upper edge thereof, the lid having a central portion, an adjacent corner portion for folding with respect to the central portion along a line angled with respect to said edge of the lid and intersecting said edge of the lid at a closed end of a notch, and positive locking tab for engaging with a slot disposed in the front side panel, wherein the positive locking tab includes a main end portion, the main portion and the end portion having a combined first length greater than the length of the slot, and the main portion is connected to the lid along a second length, the second length being approximately equal to the length of the slot wherein the end portion of the positive locking tab and an edge of the lid forming the notch therebetween for engaging with the front side panel at an end of the slot, said adjacent corner portion adapted to be folded with respect to the central portion along a line angled with respect to said edge of the lid and intersecting said lid edge to facilitate insertion of the locking tab into the slot.

2. A container according to claim 1, further comprising a front edge panel connected to the front side panel along the upper edge of the front side panel, and wherein the container has a fold along the upper edge of the front side panel, the slot being formed along the fold, so that engaging the notch causes the end portion of the locking tab to be captured beneath said fold and between the front side panel and the front edge panel.

3. A container according to claim 1, wherein folding the corner portion of the lid along said angled line causes the notch to rotate with respect to the slot and permits the notch to engage the front side panel.

4. A container according to claim 1, wherein the slot has a tapered shape with said end of the slot being wider than an opposite end of the slot.

5. A container according to claim 1, wherein said container has an elongated rectangular oblong shape and the lid has two locking tabs proximate to opposite ends of the lid.

6. A container according to claim 5, wherein each of said locking tabs is connected to a corner portion of the lid for folding along a line angled with respect to the edge of the lid, each said line having a first end intersecting the edge of the lid at a closed end of the notch corresponding to the respective locking tab and a second end intersecting a rear corner of the lid.

7. A container according to claim 6, wherein said locking tabs are disposed symmetrically with respect to a lateral midline of the container, and each of said locking tabs corresponds to a slot having a wide end proximal to the midline and a narrow end distal to the midline.

8. A blank foldable into a container, comprising:

a bottom panel;

a rear panel connected to the bottom panel along a lower rear score line;

a front panel connected to the bottom panel along a lower front score line, the front panel having a slot formed therein; and a lid connected to the rear side panel along an upper rear score line, the lid having a central portion, an adjacent corner portion connected to the central portion along a score line angled with respect to said edge of the lid and intersecting said edge of the lid at a closed end of a notch, and a positive locking tab connected thereto, wherein the positive locking tab includes a main portion and an end portion, the main portion and the end portion having combined gas-a first length greater than the length of the slot, and the main portion is connected to the lid along a second length, the second length being approximately equal to the length of the slot and the end portion of the positive locking tab and an edge of the lid forming the notch therebetween.

9. A blank according to claim 8, wherein the front panel includes a front side panel connected to the bottom panel and a front edge panel connected to the front side panel along an upper front score line, and wherein the slot is formed along the upper front score line.

10. A blank according to claim 8, wherein the slot has a tapered shape with said end of the slot being wider than an opposite end of the slot.

11. A blank according to claim 8, wherein the lid has two locking tabs connected thereto and proximate to respective opposite corners of the lid, and each of the locking tabs is connected to a corner portion of the lid along a score line angled with respect to the edge of the lid, each said angled score line having a first end intersecting the edge of the lid at a closed end of the notch corresponding to the respective locking tab and a second end intersecting a rear corner of the lid.

12. A blank according to claim 11, wherein said locking tabs are disposed symmetrically with respect to a lateral midline of the blank, and each of said locking tabs corresponds to a slot having a wide end proximal to the midline and a narrow end distal to the midline.

13. A blank according to claim 8, wherein the blank is formed of corrugated paperboard.

14. A method for forming a container, comprising the steps of:

providing a foldable blank including a bottom panel;

a rear panel connected to the bottom panel along a lower rear score line;

a front panel connected to the bottom panel along a lower front score line, a slot being formed in the front panel; and a lid connected to the rear side panel along an upper rear score line, the lid having a central portion, a corner portion connected to the central portion along a score line angled with respect to an edge of the lid, and a positive locking tab connected to the corner portion, the positive locking tab including a main portion and an end portion having a combined first length greater than the length of the slot, the main portion being connected to the corner portion of the lid along a second length approximately equal to the length of the slot, the end portion of the positive locking tab and an edge of the lid forming a notch therebetween, the angled score line intersecting said edge of the lid at a closed end of the notch;

folding the blank along the lower rear score line, the lower front score line, and the upper rear score line to approximate said edge of the lid to the front panel;

folding the blank along the angled score line, thereby rotating the positive locking tab with respect to the slot in a first rotation direction;

engaging the end portion of the positive locking tab with the slot and engaging the front panel at an end of the slot with the notch;

again folding the blank along the angled score line, thereby rotating the positive locking tab in a second rotation direction opposite the first rotation direction so that the main portion of the positive locking tab engages with the slot and the end portion of the positive locking tab extends beyond the slot.

* * * * *